US005594978A

United States Patent [19]

Ferraro

[11] Patent Number: 5,594,978

[45] Date of Patent: Jan. 21, 1997

[54] EXPANDER FOR TUBULAR FABRICS

[75] Inventor: Gian F. Ferraro, Olgiate Olona, Italy

[73] Assignee: Albrecht Equipamentos Industrials Ltda., Joinville, Brazil

[21] Appl. No.: 459,115

[22] Filed: Jun. 2, 1995

[30] Foreign Application Priority Data

Jun. 3, 1994 [IT] Italy ..... MI94A1164

[51] Int. Cl.[6] ..... D06C 5/00

[52] U.S. Cl. ..... 26/84; 26/83

[58] Field of Search ..... 26/80, 83, 84, 26/85, 81

[56] References Cited

U.S. PATENT DOCUMENTS

| | | | |
|---|---|---|---|
| 2,415,185 | 2/1947 | Moon | 26/84 |
| 2,507,599 | 5/1950 | Johnson | 26/84 |
| 2,590,938 | 4/1952 | Cohn et al. | 26/84 |
| 2,634,488 | 4/1953 | Cohn et al. | 26/84 |
| 3,175,272 | 3/1965 | Cohn et al. | 26/84 |
| 3,875,624 | 4/1975 | Frezza | 26/84 |
| 4,173,812 | 11/1979 | Cecere | 26/84 |
| 4,947,529 | 8/1990 | Werner et al. | 26/83 |

*Primary Examiner*—Amy B. Vanatta
*Attorney, Agent, or Firm*—Kuhn and Muller

[57] ABSTRACT

A fabric expander apparatus for tubular fabrics includes at least two first internal wheel and belt assembly groups kept in position inside and on the sides of the fabric tube by second external corresponding wheel and belt assembly groups. Each first internal wheel and belt assembly group includes a plate which has a wheel conducted by counter-wheels of the second external group and driven wheels. All these wheels from the first internal wheel and belt assembly group have a part of the perimeter exposed outside the plate and in a direction of the second external group, to receive a conveyor belt, which moves in a desired direction to transport the fabric tube. Motor wheels of the second external group are pressed against the conveyor belt and against the wheels of the first internal wheel and belt assembly group to compress the fabric and to contribute to transport it in the desired direction.

4 Claims, 3 Drawing Sheets

EXPANDER FOR TUBULAR FABRICS

FIELD OF THE INVENTION

The present invention refers to an expander for tubular fabrics.

BACKGROUND OF THE INVENTION

In the knit textile industry, fabrics are produced in tubular form, which fabrics are worked on while in a string configuration or the fabrics are worked on in open width. That is, in the open width the fabrics are contacted on the flattened fabric tube until its walls are joined together among themselves and expanded to the limit allowed by its elasticity, in the condition that the fabric is in, whether dry or wet, according to the maker or client specific needs. Such a process, for example, is known as calendering, when the fabric is pressed between revolving cylinders.

Many types of expanders are well-known, such as:

a) traditional old and primitive expanders, like those that consist of a wooden mold, of which the width is equal to that width, which one wants to give to the fabric, which is put into the fabric tube, adjacent to the revolving cylinders that pull the fabric through;

b) Types which consist of a pair of rings placed at a distance. Each ring is put into the fabric tube and kept at the desired distance through a pair of wheels placed in V-shaped configuration on the external side of the tube and against an internal surface of the corresponding ring, so that the fabric, which is pulled by the conveyor cylinders, will be located between the internal rings and external wheels;

c) More modern expander types, which are still in use, which consist of two metallic molds put inside of a fabric tube. The molds are properly placed at a distance through an adjustable distance device, and each mold has a pair of internal wheels that oppose and rotate opposite to each internal wheel of a pair of external control and support wheels. The molds may have auxiliary belts for the transportation of the fabric as shown in FIG. 1;

d) and at last, the request document of European patent No. 87830320.5 describes an expander which is proper for dry fabrics, which has the characteristics of not having the distance separator device of the two metallic molds inside the fabric tube. This prior art fabric expander has placed at a distance along the external sides of each mold two pairs of external-internal wheel and belt assembly groups, each group with a driven wheel having an internal convex edge, driven by a motor wheel having an external concave edge and which is supported by two external wheels placed in a V-shaped configuration against its external sides, so that both molds are supported in the desired position during the fabric expansion operation. An internal belt spins around wheels placed along the mold and follows the fabric in its movement as shown in FIG. 2.

The prior art fabric expanders "a)" and "b)" above noted present the inconvenience of having an operation which is not accurate and which is not reliable enough. The prior art fabric expanders "c)" and "d)" above noted have the inconvenience of being heavy and large, and these expanders may damage the fabric because of the great number of wheels in contact with the fabric.

SUMMARY OF THE INVENTION

The expander of the present invention solves the inconveniences of the prior art techniques and conditions. It has a pair of first wheel and belt assembly groups operating internal within the fabric tube. Each wheel and belt assembly group includes a plate over which wheels and belts are assembled to transport the fabric tube, and it has at least one pair of second wheel and belt assembly groups external to the fabric tube. Each one of the second group includes motor wheels placed in V-shaped configuration against one of the internal wheels to set it into movement. Each one of the aforesaid plates has:

a) sensibly in medium position, along its longitudinal extension, at least one first driven wheel, which wheel has a perimeter in the shape of two open wings which form a first concave opening at the botton of which opening there is a second opening having a V shaped configuration, in which is received a first conveyor belt having a reciprocal V shape configuration for the fabric transportation. (For purposes of clarity, each such driven wheel has a perimeter which shows in cross section, opposite pairs of outwardly extending wings, so that when viewed in cross section, the first driven wheel bears an "X" shaped configuration at its side ends, when viewed in cross section, as in FIG. 6 herein. For simplicity the driven wheel will be referred to herein as a "wheel in X").

b) on the previous and posterior parts of such "wheel in X," at least one second driven wheel having an opening in a V shape configuration in which V-shaped opening is received the first conveyor belt in a reciprocal V shaped configuration, when viewed in cross-section, which stays linked on the "V" shaped openings of the aforesaid "wheel in X" and of the aforesaid second driven wheels. The first conveyor belt stays closed over such wheels, to spin around with them when the "wheel in X" is set into movement and to be in contact with the fabric, which fabric is pressured against it by two wheels of the second external wheel and belt assembly group to transport it to a desired direction. Furthermore, each one of such second external wheel and belt assembly groups include:

c) at least one motor wheel driven by a conventional motor element that has a convex perimeter which fits pressured inside the concave perimeter of the aforesaid "wheel in X", which has at least one concentric fixed pulley, which pulley is linked to a transmission belt that transmits the movement to:

d) at least one balancing driven wheel, on the previous or posterior part of such driven wheel, elastically kept fastened with the convex perimeter inside the concave perimeter of the "wheel in X" and against the first V-shaped conveyor belt, and that has a concentric fixed pulley in which such transmission belt is linked to;

e) a pair of conducting counter wheels moved by such belt, and that has a concentric fixed pulley in which such transmission belt is linked to;

f) a pair of conducting counter wheels moved by such transmission belt. Each one of the counter wheels applies pressure with a wide edge against the external surface of the open wings of such "wheel in X", through the interposed fabric, the same wheels, to keep conveniently distant the relative plate by the opposite plate inside the fabric tube and to transport it to the desired direction and width.

The "wheel in X" and the driven wheels, fixed on the plate, are all composed of two parts which parts are sensibly equal in relation to the median plane which passes through the "V" shaped opening, so that they can be assembled over the same plate, over appropriate roller bearings placed in corresponding bushings fixed on the plate, in proportion with the aforesaid median plane and the perimeter which is external to the plate edge.

Furthermore, the position of the pair of conducting counter-wheels may vary along the external surface of the open wings of the "wheel in X", so as to vary the rotation speed of the last one.

An important advantage, due to the construction of the wheels of the first wheel and belt assembly group in two halves, is that one has the maximum reduction of the thickness of the device, the maximum symmetry of the mechanical actions in relation to the work planes and, above all, that such driven wheels and wheels in X, surpassing in part the plate perimeter, cause the conveyor belt to function on the plate exterior, sensibly covering all of its edge turned to the fabric, so that the fabric is mainly in contact with the belt, instead of being in contact with the hard parts of the plate.

Another advantage is in the fact that it is enough that only one of such pairs of first and second wheel and belt assembly groups is on each side of the expanded fabric tube, due to the balancing driven wheels of the second wheel and belt assembly group placed against such driven wheels of the first wheel and belt assembly group and against the conveyor belt, which also brings forth the advantage that the plates may be notably short when the device operates in a squeezer machine of the "foulard" type, in which the contact duration between the device and the fabric may be short.

If, on the contrary, the device operates in a calender or vaporizer where such duration must be greater, then the plates will be suitably long so as to keep a suitable number of driven wheels.

DESCRIPTION OF THE DRAWINGS

The present invention can best be understood in conjunction with the accompanying drawings which.

DETAILED DESCRIPTION OF THE DRAWINGS

In order to better explain the present invention two known prior art fabric expanders are briefly shown in FIGS. 1 and 2, and the fabric expander of the present invention is described with reference to the consecutive FIGS. 3–7.

Figure 1:
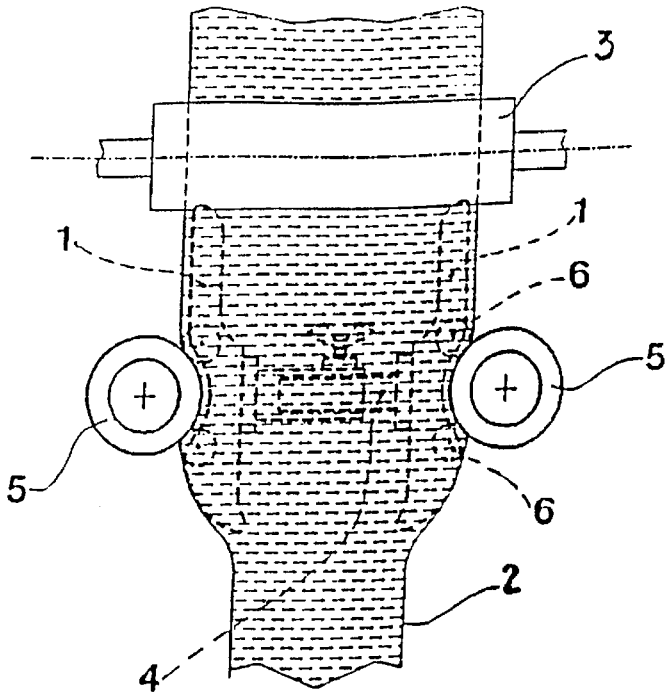
FIG. 1 is a side elevational view of a prior art fabric expander.

Therefore, FIG. 1 shows a known prior art fabric expander in which two opposite plates (1) are placed inside a fabric tube (2) and are put under the cylinders (3). Opposite plates (1) are kept in position through an internal separator (4), which two external rotatable motor wheels (5), contact against and strike on internal conducted wheels (6) through the fabric tube, (2) make the fabric tube (2) advance.

Figure 2:
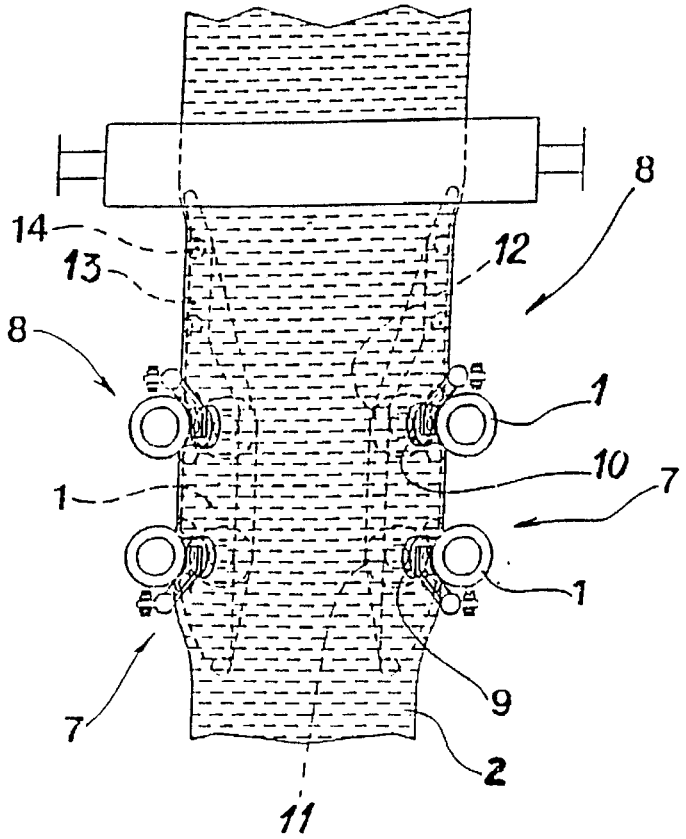
FIG. 2 is a side elevational view of another prior art fabric expander.

FIG. 2 shows another known prior art expander in which two opposite plates (1) inside a fabric tube (2) are kept in position through a first pair of external-internal groups (7) lengthwise placed at a distance away from a second pair of external-internal groups (8) in which the external motor counter wheels (9 and 10) placed in a V-shaped configuration, respectively, internal conducted counter-wheels (11 and 12) support the plates (1) and transport the fabric (2) with the aid of sliding belts (13) over internal driven wheels (14).

Figure 3:
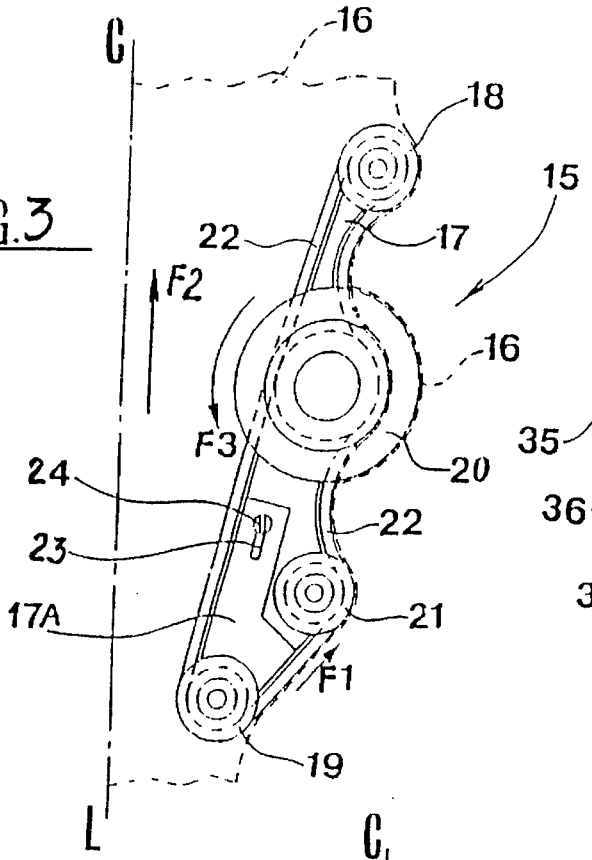
FIG. 3 is a side elevational view of a first wheel and belt assembly group of the present invention.

FIG. 3 is a side view of a first wheel and belt assembly group of the fabric expander of the present invention.

Figure 4:
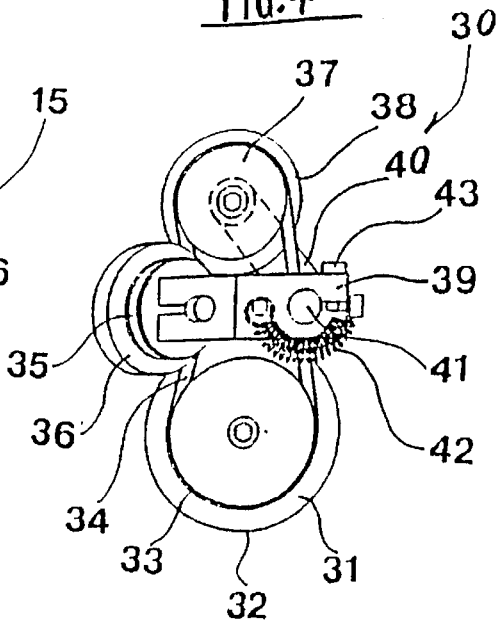
FIG. 4 is a side elevational view of a second wheel and belt assembly group of the present invention.

FIG. 4 is a side view of a second wheel and belt assembly group of the fabric expander of the present invention.

Figure 5:
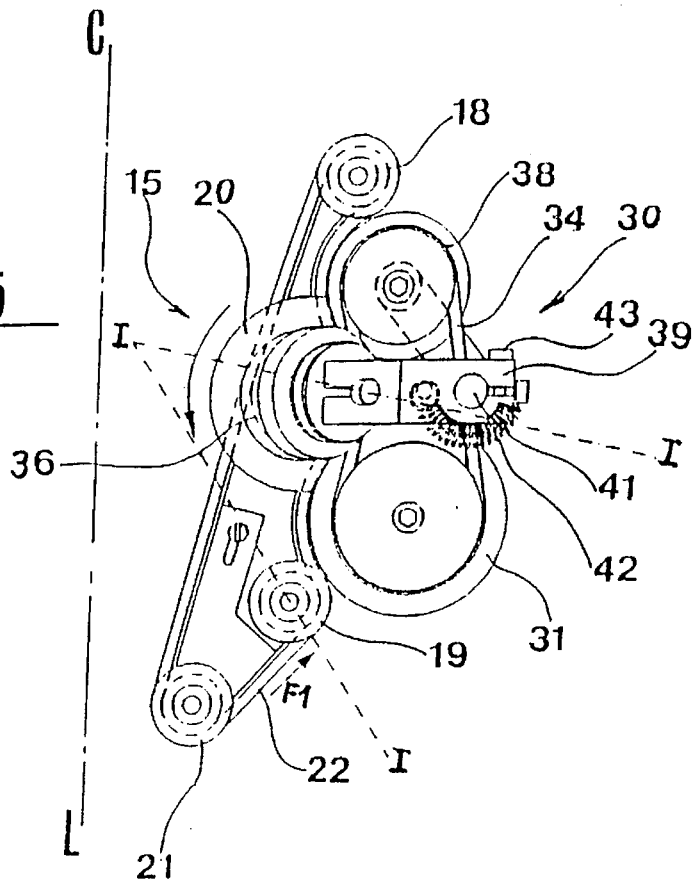
FIG. 5 is a side elevational view of the first and second wheel and belt assembly groups as in FIGS. 3 and 4, shown operating together.

FIG. 5 is a side view of the set of both wheel and belt assembly groups.

Figure 6:
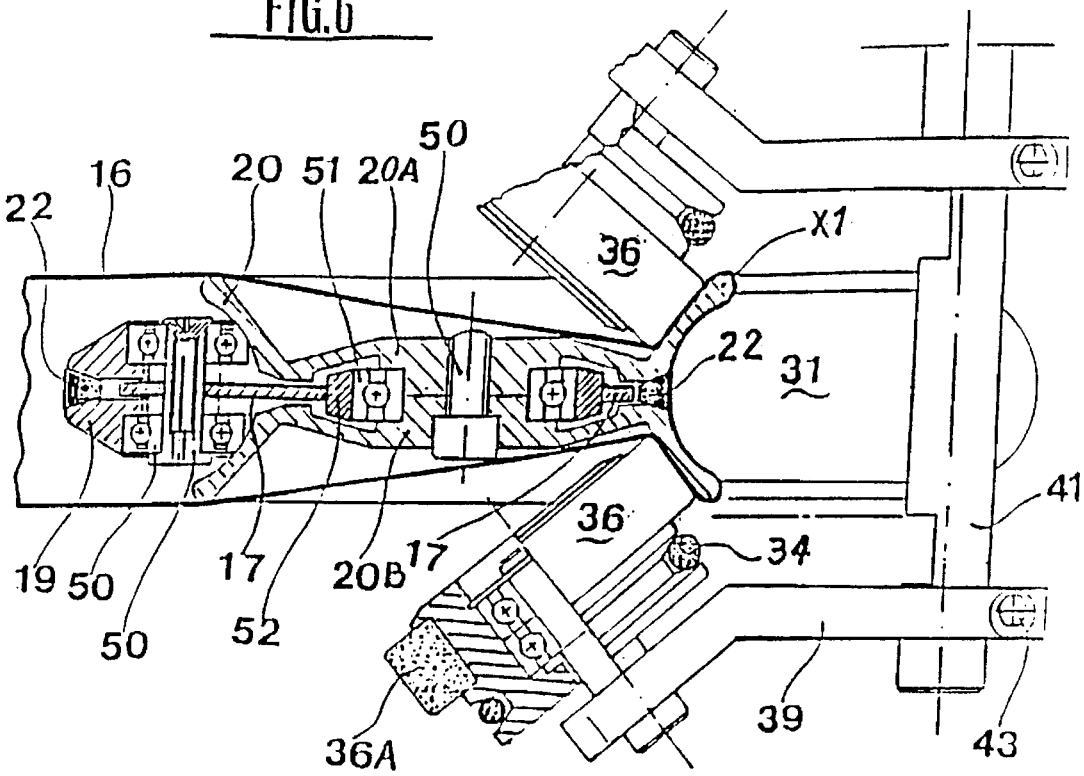
FIG. 6 is a top plan view of the first and second wheel and belt assembly groups as in FIG. 5 taken along lines I—I—I in partial section.
Figure 7:
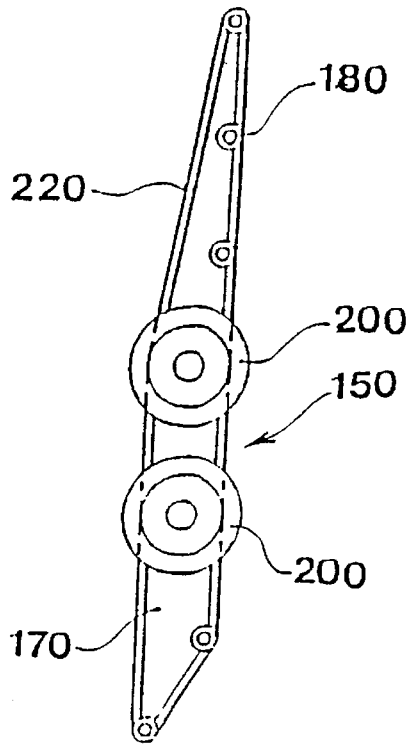
FIG. 7 is a side elevational view of an alternate embodiment of a first wheel and belt assembly group.

FIG. 6 is a top plan view partially sectioned according to lines "I—I—I" of FIG. 5 and FIG. 7 is a side view of a side view of a different embodiment for a wheel and belt assembly group of the first wheel and belt assembly group of FIG. 3.

FIG. 3 shows the fabric expander of the present invention, separated from the rest of a fabric expander, wherein the fabric expander includes right side first wheel and belt assembly group (15) which, contacts against an inside portion of a non-indicated fabric tube, not shown, except for its outlined profile (16). Line "C/L" indicates the half height of the fabric tube so that it is understood that the expander holds another left wheel and belt assembly first group (15) over the left part of such tube (16). Such first wheel and belt assembly group includes a plate (17) on which its upper and lower ends two driven wheels (18) and (19) are assembled. Wheel (18) and (19) are provided with an edge opening in a V-shaped configuration, while in a sensibly medium position within plate (17) driven "wheel in X" (20) is assembled, which "wheel in X (20)" has, not conspicuous on the figure, a concave opening on the bottom in which there is a further inner opening in a V-shaped configuration, as shown in FIG. 6 and, beneath such "wheel in X" (20), a third movable wheel (21) is assembled. All the aforementioned are in two halves, as is above explained and as can be seen in FIG. 6. Wheels (18) (19) (20) (21) have a part of their respective perimeters that may surpass plate (17) so that conveyor belt (22), which conveyor belt (22) is closed over the V-shaped openings of the four aforesaid wheels (18) (19) (20) and (21), moves according to directional arrow F1 shown in FIG. 3. Conveyor belt (22) is in contact with the fabric to tranport it in the direction of directional arrow F2 as shown in FIG. 3. In FIG. 3, conveyor belt (22) is indicated in the position that is rotatably positioned over the complete wheel and belt assembly group device (15), according to what is shown on FIG. 5. "Wheel in X" (20) is caused to be put into rotation according to directional arrow F3 by the rotation of counter-wheels (36) of the second external wheel and belt assembly group (30), according to what is shown in FIGS. 4 and 5. Plate (17) includes on its lower part an auxiliary element (17A) supplied with an eyelet (23). Auxiliary element (17A) which takes wheel (19), may be removed by means of screw (24) to conveniently regulate the belt-tension of conveyor belt (22). As shown in FIG. 5, following the outlined profile of fabric tube (16), one can see that, corresponding to "wheel in X" (20), the outline divides itself in an internal part which corresponds to the bottom of the concave opening, because the fabric in reality overlaps such two parts of "wheel in X" (20), as can be better seen in FIG. 6.

FIG. 4 shows, isolated from the rest of the expander, a second external wheel and belt assembly group (30) which contacts an external portion of fabric tube (16). External wheel and belt assembly group 30 includes one motor wheel (31), controlled by a non-indicated electric motor, which wheel (31) has a convex perimeter edge (32) which connects itself to the concave opening of wheel in X (20) of the first wheel and belt assembly group (15) and motor wheel (31) has on both sides two concentric pullies (33), each one with a V-shaped opening that receives a transmission belt (34), which transmits the movement of one concentric pulley (35) with a counter wheel (36), which are paired, one behind the other, tightened against the external edges of "wheel in X" (20) of the first wheel and belt assembly group (15) so as to give it movement through the fabric. Conveyor belt (34) closes itself over one pulley (37) of a further wheel (38) that has a convex perimeter that connects itself to the concave opening of "wheel (38) in X" (20). Supports (39) support both conducting counter-wheels (36) and one bar (40) which supports wheel (38) and it is elastically controlled on its oscillation over shaft (41) and in its working position by means of spring (42). The position of counter-wheels (36) may be regulated along the external surface of the open wings of wheel in X (20), approaching or keeping away from such first wheel and belt assembly group (15) shaft (41) with means non-indicated and by removing supports (39) over the axle (41) through screws (43).

FIG. 5 shows the two wheel and belt assembly groups (15) and (30) associated together in the work position, separated only by the fabric, not indicated. Wheels (31) and (38) are kept in a position with their respective perimeter edges inside concave opening of the "wheel in X" (20), the first also against the belt (22) and wheel (19), the second also against belt (22) and the wheel (18); the two counter-wheels (36) act against the external edges of the "wheel in X" (20), as is shown in FIG. 6.

Top Plan View FIG. 6 mainly shows the way how wheels (18), (19), (20) and (21) are positioned astraddle of plate (17), being shown in two symmetrical halves. For example, "wheel in X" (20) includes one half (20A) and another half (20B) closed over plate (17) through screw (50). "Wheel in X" (20) rotate and spins around over roller bearings (51) kept in place by bushings (52) fixed over plate (17). Fabric tube (16) is indicated by reference number (16) and the parts over which fabric tube (16) is wrapped up are well seen in FIG. 6. Conducting external counter-wheels (36) press an outside portion of fabric tube (16) over the external edges of the open wings X1 of "wheel in X" (20), with a protective wide perimeter band (36A) of neoprene. Motor wheel (31) rotates with its own convex perimeter edge inside the concave opening defined between wings X1 of "wheel in X" (20).

The other conspicuous parts of FIG. 6 are not described, since that they can be recognized on the previous FIGS. 3–5 through the reference numbers therein.

FIG. 7 is presented only to show in a very schematically way an alternate embodiment for a first internal group (150) of a fabric expander in which it is convenient that the fabric is followed by a particularly long distance. Thus, plate (170) includes two "wheels in X" (200) and five wheels (180). All of wheels (200) (180) are closed over by a conveyor belt (220), according to the embodiment previously illustrated in FIGS. 3–6. Therefore, a second external group is not shown, since it is easily understood that it will have at least one motor wheel and two pairs of counter-wheels to act upon the two wheels in X.

It is noted that other modifications may be made to the present invention, without departing from the spirit and scope fo the present invention, as noted in the appended claims.

What is claimed is:

1. An expander for tubular fabrics, said fabric expander having at least one pair of first internal wheel and belt assembly groups (15) contacting an internal portion of the fabric tube (16), each said wheel and belt assembly group having one plate (17) over which the wheels and belts are assembled to transport the fabric tube, said fabric expander further having at least one pair of second external wheel and belt assembly groups (30) contacting an external portion of the fabric tube (16), wherein each said external wheel and belt assembly group includes motor wheels placed in a V-shaped configuration against one of the internal wheels to set said internal wheels into movement, comprising each plate of said aforesaid plates (17, 17A) having a) in a medial position, along the longitudinal extension of said plate (17) at least one first conducted wheel (20), said wheel having a perimeter edge in the shape of two open wings (X1) which said open wings form a first concave opening in the bottom of which said concave opening there is provided a second opening having a V shaped configuration, and a first conveyor belt received in said second opening and having a V shape section when viewed in cross-section to transport the fabric tube;

b) said first conducted wheel (20), communicating rotationally with and transmits movement to at least one second driven wheel (18), (19), (21), said at least one second driven wheel having an opening in V shape configuration in which said opening is received said first conveyor belt (22), which said conveyor belt (22), is linked to said V-shaped openings in said first conducted wheel (20) and said at least one second driven wheel (18), (19), (21), said conveyor belt being closed and engageable over said at least one second driven wheel to spin around with said at least one second driven wheel when said first conducted wheel (20) is set into movement, said conveyor belt contacting with the fabric tube (16), said fabric fastened against said belt through said wheels (36) of the second external group of wheels (30), said belt transporting said fabric in a desired direction (F2).

2. The fabric expander as in claim 1 wherein each one of said external wheel and belt assembly groups (30) comprises:

at least one motor wheel (31) driven by a conventional motor element, which said at least one motor wheel has a convex perimeter engageable with a concave perimeter of said first conducted wheel (20) and said at least one motor wheel (31) having at least one fixed concentric pulley (33) to which a transmission belt (34) is linked, said transmission belt transmitting movement to:

at least one equalized counter balanced driven wheel (38), rotatable in a first direction at a location before a location of said motor wheel (31), and in a second contrary direction, at a location after said location of said motor wheel (31), said driven wheel (38) being kept elastically tight (42) with said convex perimeter of said motor wheel being movable inside said concave perimeter of said first conducted wheel (20) and against said first conveyor belt (22) and which has a fixed concentric pulley (37) to which such transmission belt is linked (34); and, one pair of conducting counter-wheels (36) movable by such transmission belt (34), wherein each counter-wheel presses with a wide edge (36A) an external side (X1) of said first conducted wheel (20), through the fabric tube (16) interposed between such wheels (20, 36), to keep said plate placed at a distance (17, 17A) from the opposite plate inside the fabric tube (16) and to transport the fabric to the desired direction (F2) and width.

3. The expander for tubular fabrics according to claim 2, wherein said first conducted wheel (20) and said driven wheels (18), (19), (21) are fixed over said plate (17), (17A), said first conducted wheel comprising two parts (20A, 20B) equal in relation to the medial plane that passes through said V-shaped opening so that said parts (20A, 20B) are assembled over said plate (17) in symmetry with such median plane with a perimeter having an external part of said plate edge (17).

4. The expander for tubular fabrics according to claim 2 further comprising presenting means (39), (41), (43) to vary the position of said pair of conducting counter-wheels (36) along the external sides of the open wings (X1) of said first conducted wheel.

* * * * *